United States Patent [19]

Heine et al.

[11] Patent Number: 4,630,878

[45] Date of Patent: Dec. 23, 1986

[54] APPARATUS FOR THE REMOTE-CONTROLLED CONNECTING OR SEPARATING OF TWO COUPLING PARTS

[75] Inventors: Franz Heine, Dortmund; Heinz-Joachim Rüttershoff, Schwelm, both of Fed. Rep. of Germany

[73] Assignee: O&K Orenstein & Koppel Aktiengesellschaft, Berlin, Fed. Rep. of Germany

[21] Appl. No.: 593,594

[22] Filed: Mar. 26, 1984

[30] Foreign Application Priority Data

Mar. 26, 1983 [DE] Fed. Rep. of Germany ..... 3311502

[51] Int. Cl.[4] ..... H01R 13/62

[52] U.S. Cl. ..... 339/75 M; 339/35

[58] Field of Search ..... 339/64 R, 64 M, 75 R, 339/75 M, 117 P, 35; 100/265, 268, 269 B

[56] References Cited

U.S. PATENT DOCUMENTS 2,980,013 4/1961 Swick et al. ..... 100/269 B 3,635,184 1/1972 Liautaud ..... 339/75 M 3,761,215 9/1973 Tondato ..... 100/268

4,227,765 10/1980 Neumann et al. ..... 339/64 R

FOREIGN PATENT DOCUMENTS 2856039 8/1979 France .

8125814 9/1981 France .

2902512 10/1981 France .

3110527 12/1983 France .

*Primary Examiner*—John McQuade

*Attorney, Agent, or Firm*—Martin A. Farber

[57] ABSTRACT

Method and apparatus for the remote-controlled connecting or separating of two coupling parts each of which is provided with mechanical form-lock elements and with control-line connectors, one of which parts is provided on the working tool and the other on the dipper stick or the like of a hydraulic excavator, which parts can be connected in force-locked manner by a hydraulic-mechanical locking device, each connecting or separating process comprising two successive individual processes.

1 Claim, 4 Drawing Figures

Figure 1:
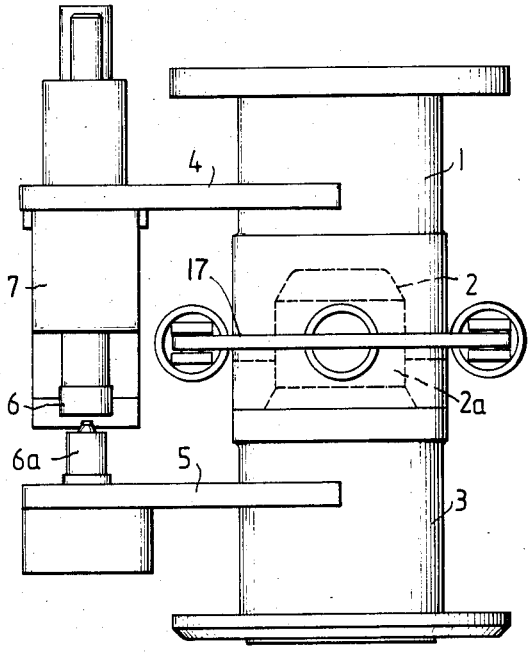

APPARATUS FOR THE REMOTE-CONTROLLED CONNECTING OR SEPARATING OF TWO COUPLING PARTS

The present invention relates to an apparatus for the remote-controlled connecting or separating of two coupling parts each equipped with mechanical form-locking elements and with control-line connectors, one of which parts is provided on the working tool and the other on the dipper stick or the like of a hydraulic excavator, which parts can be connected in force-locked manner together by a hydraulic-mechanical locking device.

The working tools on, in particular, multipurpose hydraulic excavators, must be replaced depending on the nature of the work to be done and thus frequently after relatively short periods of time.

In such cases, upon replacement of the working tool it is necessary to open the mechanical connection between the carrying devices such as a dipper stick or the like, and a first working tool, and then to establish connection between the carrying device and a second work tool. Furthermore, upon such change of the working tool, the connections of the feed lines which extend from the source of energy present on the hydraulic excavator to the actuating device on the working tool must be disconnected and connected again. Therefore, upon a change of a working tool there takes place a connecting and disconnecting of both the mechanical connection and of the control connectors of the energy supply lines. Hydraulic oil, electrical energy and compressed air represent customary sources of energy for the working tools used. The disconnecting of a first working tool from the hydraulic excavator or its dipper stick and the subsequent connecting of a second working tool formerly had to be carried out manually by suitable operating personnel. This was time-consuming and involved the difficulty that the objects to be coupled were of considerable weight and, accordingly, required also an additional person who instructed the excavator operator. The obvious expense was disadvantageous.

In order to remedy this situation a coupling with hydraulic rotary drive is already known for coupling work tools to the dipper stick of hydraulic excavators or booms or the like in which a rotary drive which can be connected to the stick or boom forms the one side of the coupling on the driven side of the rotary drive and is provided with a pin which is aligned with the axis of rotation and eccentric and parallel to said pin, with at least one shorter guide bolt and two nipple-like coupling plugs for the lines of the hydraulic liquid which are shorter than the guide bolts. This arrangement is characterized by the fact that the other side of the coupling which can be connected to the working tool consists of a connector part with bores aligned with the pin and the guide bolts and self-coupling receiving parts for the coupling plugs, and that a hydraulically actuatable interlock is provided which holds together in form-locked manner the coupling sides which have been pushed together. Such an arrangement is disclosed in Federal Republic of Germany Utility Model No. 81 25 814.

Although a remote-controlled coupling of working tool and dipper stick of the hydraulic excavator can already be effected with this coupling, it has been found that a considerable disadvantage is connected therewith. The guide elements which permit the production of the form-locking of the two coupling parts, i.e., the pins, the guide bolts and the corresponding recesses assume a certain amount of play, which necessarily increases with the number of changes of the working tool. In this way, the control-line connectors which are provided fixed in a lateral holding device on each coupling part are also placed under load. After only short periods of use, leaks occur on them so that the working tool becomes unusable.

The object of the present invention is to assure the possibility of good connection of the control connectors, independent of any play which may be produced in the form-locking elements, in the case of remote-controlled coupling parts on excavator equipment having a dipper stick and replaceable working tools.

One solution to the problem consists, in accordance with a method described above and with a suitable arrangement, of forming each connecting or separating process of two successive individual processes. Control connectors are provided on the holding device of the upper coupling part, movable with respect to it, in its longitudinal direction.

In this case, the one individual process is represented by the bringing about of a form-locking (via form-locking parts 2, 2*a*) and force-locking (parts 20, 18), or unlocking, of the two coupling parts (1, 3). The other individual process consists of the separate connecting, or separating, of the control-line connectors (6, 6*a*; 8*a*, 8*b*) of the two coupling parts. A connecting process then consists of the bringing about of a form-locked and force-locked connection of the two coupling parts and a connecting of the control-line connectors, while a disconnecting process is characterized by a disconnecting of the control-line connectors and an unlocking of the force-locked and form-locked connection of the two coupling parts.

The bringing about of a form-locking and force-locking or unlocking thereof is obtained, with respect to the two coupling parts, by the guiding of form-locking and force-locking elements. In this connection, the guiding of the form-locking elements is effected by control of the carrying device and/or the working tool. On the other hand, the guiding of the force-locking element is effected by remote control by hydraulically driven mechanical power displacement, or force-setting, members.

The connecting or the separating of the control-line connectors of the two coupling parts is based on a guiding of a shift element which, displaced hydraulically, takes place by mechanical shift displacement members.

As already briefly described above, the control-line connectors form part of feed lines which may be hydraulic lines and/or electrical lines and/or the like.

In accordance with the invention, one of two control-line connectors which can be connected to each other is mounted resiliently movable, the direction of its plane of movement being perpendicular to the plane of the direction of shift, and that one of the two control connectors which does not move during the shifting process is preferably resiliently mounted. The two control connectors are thus positively brought flush together. The shift element which is displaced hydraulically with the use of a hydraulic displacement member, comprising hydraulic cylinder, is pivotally connected to the piston rod of said cylinder, i.e., a certain change in angular position of the two elements is possible without freedom of movement in the direction of movement of the piston rod. This freedom of movement is avoided almost entirely, of course, by the fact that the shift element is guided well along the abovesaid mechanical shift displacement members, for instance guide bolts. In this connection, the shift element can in addition be displaced by springs which see to it that, when the control-line connectors are connected, the connection is subjected to a certain initial tension by spring force. In a special case a further closing force can be superimposed on this by means of the hydraulic displacement member. Upon the disconnecting of the control-line connectors this therefore takes place in this sequence, hydraulically set, against the spring force.

Since every connecting or disconnecting process is formed of two individual processes which take place one after the other, the feed line which is directed from the hydraulic excavator can be switched to actuate, in succession, the hydraulically driven mechanical power displacement members and then the mechanical shift displacement members which are displaced hydraulically via the shift element, alternately by means of a controllable reversing or switching device such as a solenoid valve.

The advantage of the invention resides in the fact that, by clear separation of the form-lock and force-lock connecting processes from the shifting process of the control-line connectors (6, 6*a*; 8*a*, 8*b*), interactions between the two arrangements are avoided. Therefore a shifting of the control-line connectors always takes place when the coupling parts are in form-locked and force-locked connection. Better sealing conditions can be obtained with the interconnected control-line connectors.

Figure 4:
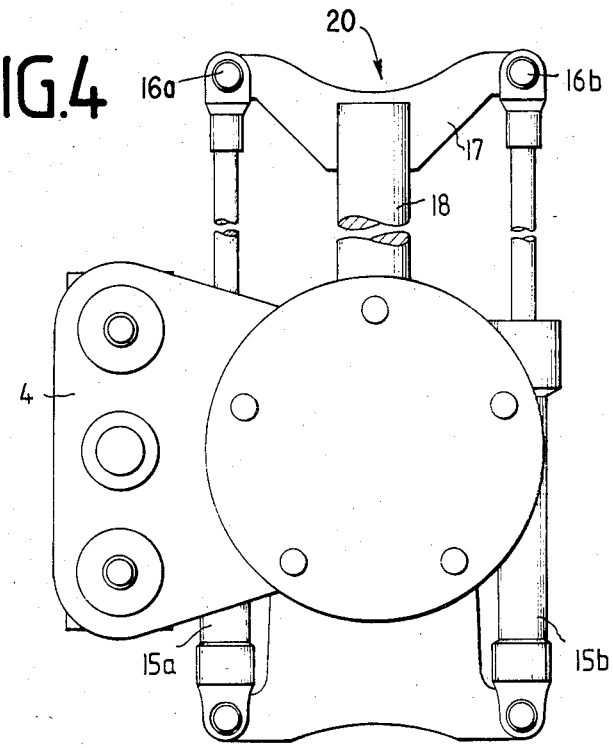
Figure 3:
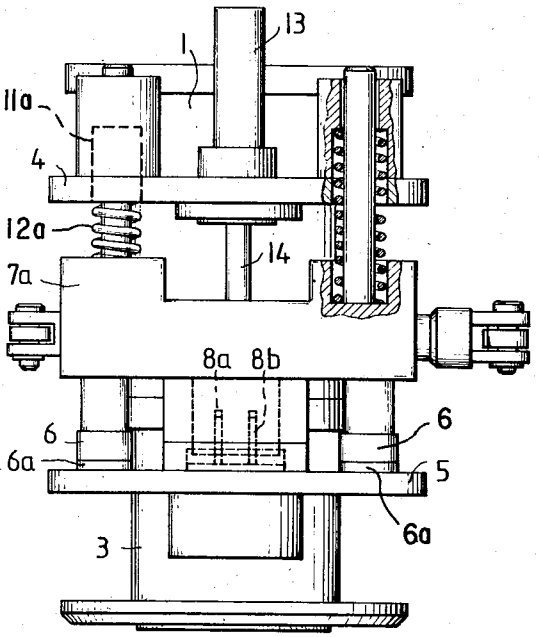
Figure 2:
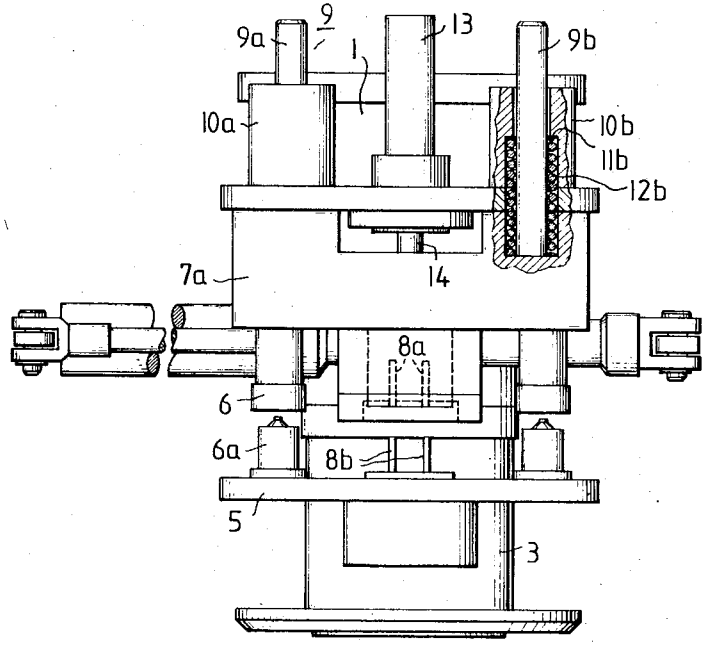

Further features of the invention will become evident from the description of a diagrammatic illustrative embodiment, described on basis of the drawing, in which FIG. 1 is an elevation view of an embodiment of the invention;

FIG. 2 a side view in partial section of the arrangement of FIG. 1 with form-locked connection of the two coupling parts and open shift paths of the control connectors;

FIG. 3 is a side view in partial section of the embodiment of FIG. 1, in which the coupling parts are interlocked by force locking and the shift paths of the control connectors are closed; and FIG. 4 is a top view of the embodiment of FIG. 1.

In the individual figures the same parts have been provided with the same reference numbers.

Referring now to FIGS. 1–4, the one upper coupling part 1 defining a bore 2 therein is connected in form-locked manner with the other lower coupling part 3 by pin 2*a*. The two coupling parts have a upper holding device 4 and a lower holding device 5, respectively. The upper coupling part 1 is pivoted to the dipper stick by a per se known rotary drive (not shown), and a locking device 20 having a direction of operation transverse to the longitudinal axis of the two lockable parts is furthermore provided on this coupling part 1.

On the upper holding device 4 of the upper coupling part 1 there can be noted controlling connectors 6 which are movable with respect to it and in its longitudinal direction. They are supported in a shift element 7, the latter being developed as a yoke 7*a*. The lower holding device 5 of the other coupling part 3 has control-line connectors 6*a* which are arranged resiliently and horizontally movable. In the figures, two pairs of control-line connectors of the hydraulic lines can be noted, but additional control-line connectors can also be provided which can be shifted in the same manner in accordance with the method of the invention.

FIGS. 2 and 3 show electric controlling connectors 8*a* and 8*b*, which are provided to make the above clear. FIG. 2 also shows that the shift element 7 has been developed as a yoke 7*a* and that it is guided by guide bolts 9*a* and 9*b*, which collectively comprise shift displacement members 9. The said guide bolts extend at their other end within guide bushings 10*a* and 10*b* which are rigidly connected with the upper holding device 4. The arrangement is such that the guide bushings 10*a* and 10*b* simultaneously have seats 11*a* and 11*b* for springs 12*a* and 12*b*, the springs 12*a* and 12*b* being tensioned against the yoke 7*a*.

In one embodiment of the present invention, the guiding of the shift element 7 is hydraulically effected by means of hydraulic cylinder 13.

Hydraulic cylinder 13 is mounted as said hydraulic displacement member in the holding device 4 of the upper coupling part 1. Its piston rod 14 is pivotally connected to the yoke 7*a*.

This connection is selected in such a manner that it acts free of play in the direction of movement of the piston of the hydraulic cylinder 13 but has a link, so that a certain change in angle between the longitudinal axis of the piston rod and the transverse axis of the yoke can take place.

For the control-line connectors, due to the character of the fluid conducted by their feed lines, it must be seen to it that certain minimum shift paths are maintained, for instance in order to avoid electric flashovers or the like. For this reason, the distance of movement or the shift path of the control-line connectors upon form-locked and force-locked connection of the two coupling parts 1 and 3 is greater than the greatest functionally required minimum shift path which is to be maintained for each control connector.

The FIG. 2 shows furthermore that control connectors can be connected together to lie opposite each other. It is possible of course for the control connectors, such as the electric control connectors 8*a* and 8*b*, for instance, to have a mounting which is resiliently movable in the horizontal plane.

FIG. 3 shows the arrangement, according to the invention, of controlling connectors 6, 6*a* and 8*a* and 8*b* which are mated, respectively, upon form-locked and force-locked connection of the coupling parts 1 and 3.

FIG. 4 shows a locking device 20 for the two coupling parts 1 and 3, which cooperates with bore 2 and pin 2*a*. This device is located on the coupling part 1 and has double hydraulic cylinders 15*a* and 15*b* which, developed as mechanical power displacement members, are connected by eye bolts 16*a* and 16*b* and at least one lever 17 with a locking bolt 18 which acts as force-locking element.

When the coupling parts 1 and 3 are apart, the double cylinders are in extracted position and the locking bolt 18 is in its unlocked position. If a working tool is now fastened to the dipper stick and if, finally, therefore the coupling parts 1 and 3 are brought together in form-locked manner via pin 2*a* entering bore 2, an opening provided in said parts through bore 2 and pin 2*a* aligns with the locking pin 18, and the locking pin 18, displaced hydraulically, can be inserted by the double cylinders 15*a* and 15*b* into said opening. A force-locked connection of the coupling parts 1 and 3 is thus produced.

While we have disclosed one embodiment of the invention, it is to be understood that this embodiment is given by example only and not in a limiting sense.

We claim:

1. An apparatus for remote-controlled coupling or decoupling of upper and lower lockable coupling parts, wherein respectively said two coupling parts are equipped with mechanical form-locking elements and with control-line connectors, one of which parts is operatively provided on a working tool and the other operatively on a carrying device of a hydraulic excavator, said parts being connectable in force-locked manner with each other by a hydraulic-mechanical locking device, said two coupling parts respectively cooperatively define a bore and a pin as the form-locking elements, said upper coupling part provided with an upper lateral holding device and said lower coupling part provided with a lower lateral holding device, the upper coupling part being connected via a rotary drive to said carrying device, and said locking device operatively transverse to the longitudinal axis of the two coupling parts, the improvement comprising:

hydraulic displacement drive means for connecting the control-line connectors separately with each other and respectively for separating said connectors from each other, a shift element, and wherein at least one of said control-line connectors is mounted on said shift element, said shift element further comprises a yoke, guide bolts, wherein said yoke is guided by said guide bolts, and wherein said guide bolts comprise shift displacement members, guide bushings, wherein each of said guide bolts extends within a respective one of said guide bushings, said guide bushings are rigidly connected to said holding device of the upper coupling part, springs, each respective guide bushing defining an internal seat for cooperation with one end of a respective one of said springs, each said spring being tensioned at its other end against said yoke.

* * * * *